United States Patent [19]

Gates

[11] 4,403,000

[45] Sep. 6, 1983

[54] METHOD OF FORMING A COHESIVE DISPLAY OBJECT

[76] Inventor: Victor Gates, 1342 Harvard, Santa Monica, Calif. 90404

[21] Appl. No.: 312,417

[22] Filed: Oct. 19, 1981

Related U.S. Application Data

[63] Continuation of Ser. No. 168,550, Jul. 14, 1980, abandoned.

[51] Int. Cl.[3] ..... B05D 1/16

[52] U.S. Cl. ..... 427/206; 427/207.1; 427/208; 156/279; 434/428; 434/430; 40/594; 40/620

[58] Field of Search ..... 427/206, 208, 208.4, 427/208.6, 208.8, 207.1, 210; 434/428, 430; 40/594, 620; 46/DIG. 1; 428/86, 90; 156/279

[56] References Cited

U.S. PATENT DOCUMENTS

| | | | |
|---|---|---|---|
| 1,620,574 | 3/1927 | Savage | 46/DIG. 1 X |
| 2,093,207 | 9/1937 | Munson, Jr. | 46/DIG. 1 X |
| 2,775,048 | 12/1956 | Berman | 46/DIG. 1 X |
| 3,502,207 | 3/1970 | Alexander | 427/206 X |
| 4,045,897 | 9/1977 | Gates | 35/7 R X |

FOREIGN PATENT DOCUMENTS

| | | | |
|---|---|---|---|
| 2400386 | 7/1975 | Fed. Rep. of Germany | 434/430 |

OTHER PUBLICATIONS

Hackh's Chemical Dictionary, 4th Edition, McGraw Hill Book Co., NY., 1969, p. 331.

*Primary Examiner*—John D. Smith
*Assistant Examiner*—Bernard F. Plantz

[57] ABSTRACT

The present invention is a method for forming a cohesive display object and associated display items. The invention contemplates a display object which is at least partially covered with flock (crushed fiberous material, such as rayon) and at least one display item which back side is at least partially covered with flock. The method comprises the steps of coating at least part of the surface of the display object and the back of the display item with a non-drying adhesive; then covering the coated surface with flock. Contact of the adjacent flock-coated surfaces of the display object and items will create a cohesive force and removably secure the display item to the display object.

7 Claims, 3 Drawing Figures

METHOD OF FORMING A COHESIVE DISPLAY OBJECT

This is a continuation, of application Ser. No. 168,550, filed July 14, 1980, now abandoned.

BACKGROUND OF THE INVENTION

1. Field of the Invention

This invention relates to a method for forming a cohesive display board.

2. Prior Art

Display boards on which items of interest may be displayed to a particular audience are well known in the prior art. Some of these display boards are made from cork or other porous material and items to be displayed thereon are secured thereto by positive mechanical fasteners such as pins, thumbtacks, etc. These types of display boards are normally used in homes, business and public places for notices, bulletins and/or information. Items secured thereto can be removed and new items afixed by removing and re-using the mechanical fastener. Another class of display boards do not use mechanical fasteners but are used where permanency is not required. The primary benefit of this display board is the ease of placing and removing the display items. The most typical display board in this class is commonly known as a flannel board. This class of display board is frequently used in lecturing or story telling and may be used in various amusement activities.

Flannel boards in the prior art are well known. A flannel board is normally comprised of a flat plate to which a piece of flannel, felt, or other suitable material is secured. The objects to be displayed also have disposed on their back a piece of material such as flannel, felt or other suitable alternative material. The item to be displayed can be attached to the display board by simply placing it on the board, in any location, and by gently rubbing the display item. The display item will adhere to the board because the interlocking of the fibers of the opposing strips of material. The display item will remain in position on the display board and can be easily removed. These prior art flannel boards are very effective for their particular uses. It has been found that many types of cloth material are suitable in the fabricating of a flannel board, the better being previously mentioned, ie., felt or flannel.

However, this cloth class of cohesive display board has specific problems which increase with use. Use causes the nap (short fuzzy ends of fibers on the surface) of the flannel material to wear out, become depressed or dirty. Likewise, the nap of the display items become worn and will not adhere to the display board. This problem cannot be avoided, flannel boards which employ cloth material simply wear out with very little use. Their life spans are short.

Flannel boards of the prior art pose other problems and have other deficiencies. One particular requirement is that the flannel material and plate must be relatively flat and the item to be displayed cannot be warped or bent, since any unevenness in the contact areas will substantially effect the cohesive force. Another dificiency is that the prior art flannel boards cannot be effectively used in the vertical position since there is not sufficient cohesive force existing between the two fabrics to overcome the gravitational force. Likewise, large objects cannot be displayed on flannel boards since the gravitational force will exceed the cohesive force and cause the object to fall.

Still another problem with the prior art flannel boards is that the back of the display item must have a strip of flannel or felt or other suitable material secured thereto. The commercial manufacturer must make the backing strips in some uniform pattern in order to be commercially marketable. On the other hand, user needs are not uniform. Hence, the user needs may not correspond with the commercial size and shape patterns available and hence, the user is forced to cut tape and piece and glue. Additionally, it is beneficial to cover a large area of the back of the display item with the flannel material to create greater surface area contact nap engagement and greater cohesive force. Covering of the surface of the display item is often difficult to do whether commercially made backing are employed or not. In other instances, the display items are either small or have intricate patterns which do not lend themselves to have secured thereto a piece of backing. It is sometimes difficult to secure to the back of some display items sufficient material to create the cohesive bond to secure the display item in place on the display board, and often the backing projects from the sides of the display items or may be exposed among internal cut-outs of the display item and partially destroy the effect of the item to be displayed.

Another problem in the prior art display boards and display objects was the inability to dispose one display item directly over another display item. In numerous instances, it is desirable to modify the display board and display items disposed thereon by placing a new display item directly over part or all of an existing display item. No prior art device provided such capability.

Flocking was not thought of as an alternate method for creating a display board until my U.S. Pat. No. 4,045,897. The Patent claims structure for a display board in which the front of the display board and the back of the display item was coated with flock, ie., crushed fiber. That invention, while conceptionally sound, in practice was ineffective, as a display surface when used in a vertical or near vertical position. Apparently, insufficient cohesive force existed between the opposing fibers. It is presumed that insufficient force existed because: (a) known adhesives so coated the fibers as to prevent them from interlocking; and/or (b) intermeshing of the fibers by themselves is inadequate to produce sufficient cohesive force.

It is particularly note worthy that all prior art flocking was accomplished by using glue that was normally applied hot to the display surface and dried, becoming hard and brittle. The display item in the prior art could not be molded, warped, bent or formed in other than a flat position. Therefore, display objects could only be planer and one-dimensional.

The present invention provides a method to produce a cohesive display object and items employing flock, which overcomes the problems of the prior art.

SUMMARY OF THE INVENTION

A method for forming a cohesive display object and display items employing flock, (crushed fibers), is disclosed. The method comprises the steps of; coating at least a portion of the back of a display item with non-drying adhesive; and covering at least the coated portion of the back of the display with flock. The method further contemplates the application of the non-drying adhesive and flock of the front of the display item to permit another display item to be disposed at least partially thereover. Display items will removably adhere to the flat, contoured, or three dimensional face of a display object formed by the method of the present invention.

It is therefore an object of the present invention to provide a method for constructing a display object on which display items can be removably displayed thereon using a flock (crushed synthetic fiber).

It is another object of the present invention to provide a method for forming a flocked display object the fibers of which will interlock and cohesively stick to the back of a display item.

It is another object of the present invention to provide a display object which can be contoured three dimensional or sculptured onto which display items can be cohesive and removably applied thereto.

It is still a further object of the present invention to provide a method for forming a display object and display members which will cohesively and removably stick together for display purposes.

It is a further object of the present invention to provide an efficient economical method for forming a display object employing flock.

DETAILED DESCRIPTION OF THE PREFERRED EMBODIMENT

The present invention relates to display objects of all kinds on which display items can be placed and easily removed. In some instances, the display object may take the form of a paper doll, a sculptured animal, a bulletin board, a picture story album or any of an innumerable other forms. The present invention teaches a method for forming a display object and items employing flock. Flock is a generic term which commonly describes a crushed fiberous material, such as wool, cotton, nylon or rayon. In the preferred form it has been found that rayon is by far the best crushed fiber to be employed. These crushed fibers have lengths generally of about 300th of an inch.

Display boards objects, etc., in the prior art are nonexistent. Some have claimed to be able to form display boards using flock, but the claims were ideas, not reality. It has been found that prior art methods for flocking prevented display use. The intermeshing of the fiber when disposed in an overlapping position did not create sufficient cohesive force to maintain their relative positions. In fact, the methods used for flocking in the prior art cannot be employed to form a display board which will permit items to be removably disposed thereon. It was proposed in the prior art that the intermeshing of the fibers of the display item and display objects created sufficient force to maintain their respective positions. However, the expected results did not materialize.

The inventor proposes at least one reason sufficient force was not created was because of the adhesive material applied to glue the fiberous flock to the surface. The adhesive was normally applied in a hot state and dried to a hardened state. Whether the adhesive so coated the fiberous material as to prevent the intermeshing of fibers or whether the hardening of the adhesive itself prevented the intermeshing is unknown. The fact remains that sufficient force could not be created to maintain display objects in contact.

The method of the present invention is to employ a relatively new adhesive which is non-drying. The adhesive is tacky to the touch and will remain so for a considerable time. In the preferred form, it has been found that an adhesive product manufactured by 3-M Company of St. Paul, Minnesota, under the brand name of Spray Mount, Catalog No. 6065, produces the desired results. The adhesive consists of: a 1,1,1 Trichlorethane; acrylic resin, a terpene resin blend; a phthalate plasticizer; and a propane-isobutane blend. The adhesive is non-staining, transparent, and will not wrinkle objects like paper.

Figure 1:
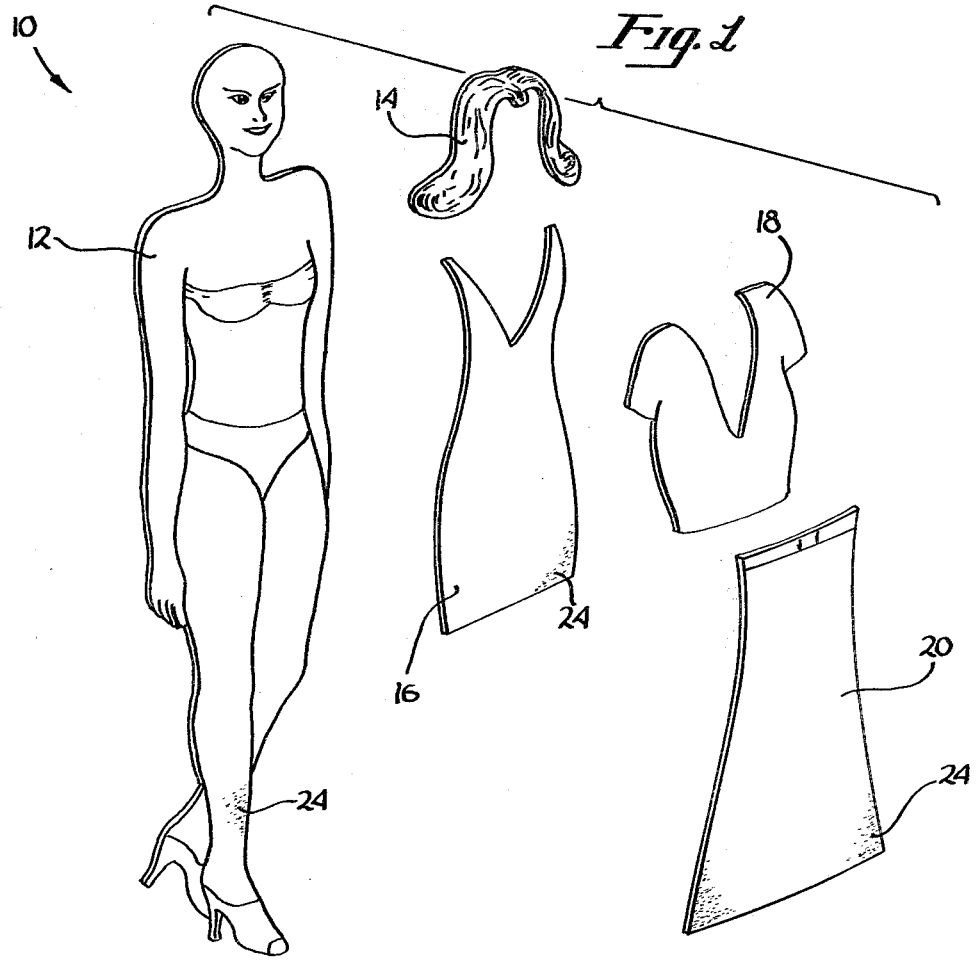
FIG. 1, is an isometric view of a display object, which in this embodiment is a paper doll showing various display items which can be disposed thereon.
Figure 2:
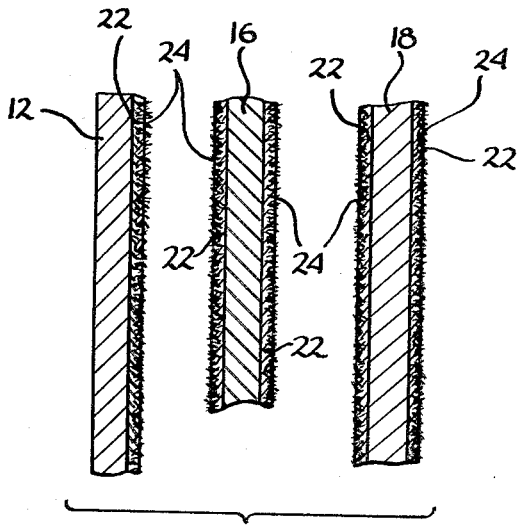
FIG. 2, is a blown-up view in cross section of a display object and two display items as shown in FIG. 1.

The present invention will be described in use on a paper doll. This is only one use of the present invention but it illustrates the use of flocking in display boards. In the preferred form, a display object 10, a paper doll, is illustrated in FIG. 1. The paper doll 10 may be made of a light cardboard material and may be flat or contoured. The display surface 12, of the paper doll is initially painted or printed in such a fashion to exhibit the necessary design or artistic impressions desired. For instance, in the preferred form, the eyes, nose, other facial features, may be printed or painted onto the surface 12, as well as other skin colors and features such as ears, etc. After the surface printing or painting is dried, the surface 12, is coated with a thin layer of the non-drying adhesive 22. It should be noted that in the form shown in FIG. 1, the entire surface 12 of the display object 10, is coated with the non-drying adhesive 22. In other uses only the portions of the surface used for display are covered with flock and consequently, the non-drying adhesive. The next step is to cover the non-drying adhesive 22 with flock. This can be accomplished in several ways. In the preferred form, the display object 10 is physically placed into a container having flock 24. Sufficient flock 24 will coat the non-drying adhesive in a relatively short time by simply moving the display object through the container holding the flock 24. The display object 10 is then shaken lightly to remove any excess flock 24.

In utilizing the method of the present invention it should be noted that the flock 24, must not be pressed, by any significant force, onto the display surface 12, and non-drying adhesive 22. The adhesive force of the glue will attract sufficient flock 24, to cover the surface without force other than the weight of the display object 10, or flock 24. The display object 12, with adhesive and flock disposed therein should then be let dry for at least two hours. If the display board is attempted to be used prior to that time, the nap of the flock 24, may be rendered useless for display by matting or otherwise.

It should be noted that in the present invention the design on the surface of the display object 12, is made by printing, painting, coloring, etc. The design shows through the flock 24, and is visually observable. In alternate forms, the flock could be colored and not transparent and be used to form the design.

Referring now to FIG. 1, the display objects 14, 16, 18 and 20, are shown. In the preferred embodiment, the display objects are hair 14, slip 16, blouse 18, and skirt 20. These objects are printed or colored to the desired design. Both sides of these display items are then coated with the non-drying adhesive 22, and then with clear flock 24.

Figure 3:
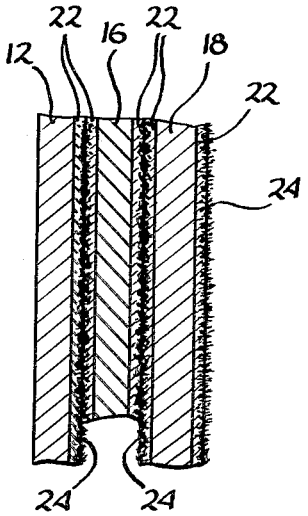
FIG. 3, is a blown-up view of the display object and overlaying display items positioned in display position.

When the various items are completed, they may be used for display in any sequence desired. In the preferred form, slip 16, may first be disposed on the body of the display object 10 and pressed gently into place. A blouse 18, may then be disposed over a portion of the slip 16, and gently pressed into place. At this point, a cross section will exist as shown in FIG. 3. The fibers of the adjacent objects will be so intermeshed as to cohesively hold the display items in their relative positions. The display object 10, may then be dressed by placing the skirt 20 and hair 14 into place. Other items such as a coat and/or other items may be positioned over the skirt and body to hold each object in position as it is disposed on top of the other object.

The result, ie., a flocked display object created by the method presented in the present invention is unexpected and unobvious. In fact, it has not yet been determined exactly what is causing the cohesive force which permits removable display. It is proposed that the non-drying adhesive 22 creates sufficient force to attract and hold numerous fibers of flock. This flock is suspended or floating on this non-drying surface 22. As the display item and object are pressed gently together, the floating flock 24 moves into such a position as to create a firm intermeshing of the fibers (FIG. 3). It is further proposed that some of the flock 24 is coated with the non-drying adhesive 22, and at least parts of the opposing fibers attract and attach because of that coated application of adhesive. It is further proposed that the flock 24, will not totally cover the non-drying adhesive 22. Thus, leaving small areas of non-drying adhesive against which fibers of the display object will stick. It is further felt that the total combination of the above mentioned features produce the unexpected effect of a display object holding firmly items for display, while likewise, permitting their ease of removability.

It has been found that the desired effects cannot be acheived by simply applying the non-drying adhesive to two opposing items. The adhesive is extremely tacky and in effect, cements the two members permanently together. Some parts of the items may be able to be removed but the cohesive force is so great that tearing or distortion occurs when thin or fragile display items are used. The flock produces a barrier of which only a portion of the ends of the nap contact the adhesive of the opposing display item. So, in addition to creating a cohesive force by intermeshing of fibers, the flock serves to lessen the cohesive force. Thus, the combination of the non-drying adhesive and the flock create a display object and items which have all the desired effects of cohesiveness with ease of removability.

Although the present invention has been described in reference to the use of a display object being a paper doll and display objects comprising various articles of clothing and apparal, the method disclosed in forming the present invention is in no way limited to that implementation. The uses of such a display board are innumerable. Further, the method of forming the present invention permits; (1) contoured display surfaces; (2) sculptured display items; or (3) bending of a surface into a particular shape during use. Display objects boards of the prior art could not be so used or formed.

Although the present invention has been described in connection with the preferred embodiment thereof, many variations and modifications will not become apparent to those skilled in the art. It is preferred therefore, that the present invention be limited, not only by the specific disclosure herein, but only by the appended claims.

I claim:

1. A method for forming a display object having at least a first surface at least partially coated with a powdered fiberous material, and display items having at least a first surface at least partially coated with said powdered fiberous material, wherein said first surface of said display object is disposed against said first surface of said display items to form a display, comprising the steps of:

(a) coating at least a portion of said first surface of said display object and at least a portion of said first surface of said display items with a thin layer of a non-drying adhesive, said non-drying adhesive consisting of: 1,1,1 Trichlorethane; acrylic resin, a terpene resin blend; a phthalate plasticizer; and a propane-isobutane blend;

(b) covering at least said coated portion of said first surface of said first surface of said display items with a powdered fiberous material such that only a portion of said fiberous material is coated with said non-drying adhesive;

whereby said display items may be removably displayed on said display object.

2. The method for forming a display object of claim 1, wherein at least two surfaces of a first display item is at least partially coated with said non-drying adhesive with said powdered fiberous material such that said first display item will removably attach to said display object and will permit at least a second display item to be removably displayed on said first display item.

3. The method for forming a display object of claim 1, wherein said powdered fiberous material is rayon.

4. The method for forming a display object of claim 1, wherein said non-drying adhesive is clear, tacky, non-wrinkling, and non-staining.

5. A method for forming a display object and at least a first display item; said display object having a first surface with a predetermined design thereon; said first display item having a first and second surface said first surface with a predetermined design thereon, said first surface of said display object and said first and second surface of said at least a first item, formed by:

(a) coating at least a portion of said surfaces a thin layer of a non-drying adhesive, said non-drying adhesive consisting of: 1,1,1 Trichlorethane; acrylic resin, a terpene resin blend; a phthalate plasticizer; and a propane-isobutane blend;

(b) covering said non-drying adhesive; said adhesive and fiberous material being transparent thereby permitting said predetermined design on said display object and said first display item to be observable;

Whereby said at least said first display item can be removably disposed on said display object by pressing said second surface of said display object such that the fiberous material and non-drying adhesive of the opposing surfaces engage each other to permit display, said first surface of said display item capable of removably receiving another display item for display.

6. The method for forming a display object of claim 5, wherein said powdered fiberous material is rayon.

7. The method for forming a display object of claim 5, wherein said non-drying adhesive is clear, tacky, non-wrinkling, and non-staining.

* * * * *